US005505351A

United States Patent [19]

Najarian

[11] Patent Number: 5,505,351

[45] Date of Patent: Apr. 9, 1996

[54] HANGER FOR A PRE-TIED NECKTIE ASSEMBLY

[76] Inventor: John Najarian, 27 Dorotockeys La., Old Tappan, N.J. 07675

[21] Appl. No.: 493,817

[22] Filed: Jun. 22, 1995

[51] Int. Cl.[6] ..... A41D 27/22; B65D 85/18

[52] U.S. Cl. ..... 223/85; 223/DIG. 1; 223/DIG. 2; 223/87; 206/806; 206/294; 206/495

[58] Field of Search ..... 223/85, 87, DIG. 1, 223/DIG. 2, 1; 206/806, 292, 294, 495; 2/152.1, 145, 148, 149, 150, 153

[56] References Cited

U.S. PATENT DOCUMENTS

| | | | |
|---|---|---|---|
| D. 194,767 | 3/1963 | Warmath III | 223/DIG. 3 |
| 3,168,197 | 2/1965 | Sconza | 223/DIG. 1 |
| 4,337,539 | 7/1982 | Najarian . | |
| 4,650,074 | 3/1987 | Vosbikiau | 206/806 |
| 5,222,638 | 6/1993 | Kolton et al. | 223/DIG. 1 |
| 5,261,580 | 11/1993 | Smith | 206/495 |
| 5,429,284 | 7/1995 | Kolton et al. | 223/DIG. 1 |

*Primary Examiner*—C. D. Crowder
*Assistant Examiner*—Bibhu Mohanty
*Attorney, Agent, or Firm*—McAulay Fisher Nissen Goldberg & Kiel

[57] ABSTRACT

A hanger for a pre-tied knotted necktie assembly is disclosed in which the assembly includes a necktie, a knot support to form a necktie knot, a clip for removably mounting the necktie assembly onto the neckband of a shirt collar, and a positioning post extending through the necktie knot. The hanger includes an upper hook portion, a central body portion, and a lower stem portion. The stem portion has an opening therethrough adapted to fit over the post of the necktie assembly whereby a retaining nut, when placed over the post with the stem portion positioned between the necktie knot and the nut, will securely maintain the necktie assembly on the hanger. Removal of the necktie assembly from the hanger is achieved by severing the stem portion from the body portion of the hanger.

13 Claims, 2 Drawing Sheets

HANGER FOR A PRE-TIED NECKTIE ASSEMBLY

BACKGROUND OF THE INVENTION

I. Field of the Invention

This invention relates in general to a hanger for a pre-tied knotted necktie assembly and, in particular, to a hanger which is securely connected to the necktie assembly for purpose of display and yet is readily removable therefrom by the customer after purchase of the assembly.

II. Description of the Prior Art

Pre-tied knotted necktie assemblies typically are connected to a hanger and displayed at the place of sale in a hanging position. An example of such necktie assembly is shown in U.S. Pat. No. 4,337,539 dated Jul. 6, 1982 entitled Necktie Knot Support Assembly which issue to and is owned by John Najarian, the same inventor identified as the applicant herein. The necktie assembly of this patent includes a necktie, a knot support on which the necktie is pre-tied to form a necktie knot, and a clip for removably mounting the necktie assembly onto the neckband of a shirt collar. The assembly together with the hanger are sold to a vendor for resale to the customer. The hanger is used by the vendor to display the assembly and includes a surface on which marketing indicia, such as the vendor's name and the sale price are posted. The hanger is intended to be separated from the assembly by the customer after the purchase is made.

Heretofore, the previously known hangers were not securely connected to the necktie assembly so that an unscrupulous customer could remove the hanger having a specified sales price and replace it with another hanger, taken from a different assembly, having a lower sales price. The result of such switching of hangers causes economic loss to the vendor.

For example, one kind of known hanger for a pre-tied knotted necktie has a hook end formed with an opening through which passes the clip portion of the necktie assembly. The clip is disposed for movement between a retaining position and a disengaging position. The clip, when in its disengaging position, passes through the opening in the hanger whereupon it is moved to its retaining position to loosely connect the necktie assembly to the hanger. However, the customer can easily move the clip to its disengaging position and replace the hanger with one having a lower sales price prior to purchase of the assembly.

Another type hanger is one that is used for displaying an unknotted necktie, that is a necktie which is not pre-tied. This kind of hanger has a slot through which passes a portion of the tie so that the tie hangs in a folded-over position. Here, again, it is relatively simple to remove the tie from the slotted hanger and connect it to another hanger having lower price indicia.

Still another kind of hanger has a slotted opening defined by two spaced-apart strip segments, one of which strips is disposed for pivotal movement to overlie the other one of said strips. One of these strips has a plurality of posts with enlarged ends which are frictionally received in suitable openings in the other one of said strips to clamp said strips together in overlying relation. The arrangement is such that when a portion of an unknotted necktie is passed through the hanger slot, the clamping of the strips together serves to secure the tie to the hanger in a folded-over position with a portion of the tie clamped between the engaged strips.

The interengagement of the posts within the respective openings is such that the customer cannot separate the hanger from the tie without first cutting off the enlarged ends of the posts. This serves to mutilate the hanger which can be readily detected at the check-out counter to alert the vendor that a switch of hangers may have taken place.

While the hanger having such clamping strips significantly reduces the incidences of a customer switching or replacing a hanger having a certain sales price with a hanger having a lower sales price, the cost of manufacturing such a hanger is relatively high as compared to the other less effective hangers discussed above.

The present invention is directed toward an improved display hanger for use with a pre-tied necktie assembly which effectively prevents the customer from switching or replacing the hangers of such assemblies, and yet is easy and economical to manufacture.

SUMMARY OF THE INVENTION

The hanger of the present invention is adapted to be used with a pre-tied knotted necktie assembly of the kind shown in U.S. Pat. No. 4,337,539 referred to above. The assembly includes a necktie, a knot support to form a necktie knot, a clip for removably mounting the necktie assembly onto the neckband of a shirt collar, and a post extending through the necktie knot to position the necktie on the knot support.

The hanger includes an upper portion connected to a central body portion which, in turn, is connected to a lower stem portion. The stem portion includes an opening therethrough positioned and sized to fit over the post of the necktie assembly. The arrangement is such that a retaining nut, when placed over the post with the stem portion positioned between the necktie knot and the nut, will securely maintain the necktie assembly on the hanger. At such time as the customer wishes to remove the necktie assembly from the hanger, after purchasing the assembly from a vendor, the customer need only sever the stem portion from the body portion of the hanger thereby to permit removal of the body portion and hook portion from the necktie assembly.

BRIEF DESCRIPTION OF THE DRAWINGS

For a more complete understanding of the invention and the various features and advantages thereof, reference is made to the following detailed description taken in conjunction with the accompanying drawings in which.

DESCRIPTION OF THE PREFERRED EMBODIMENT

Figure 1:
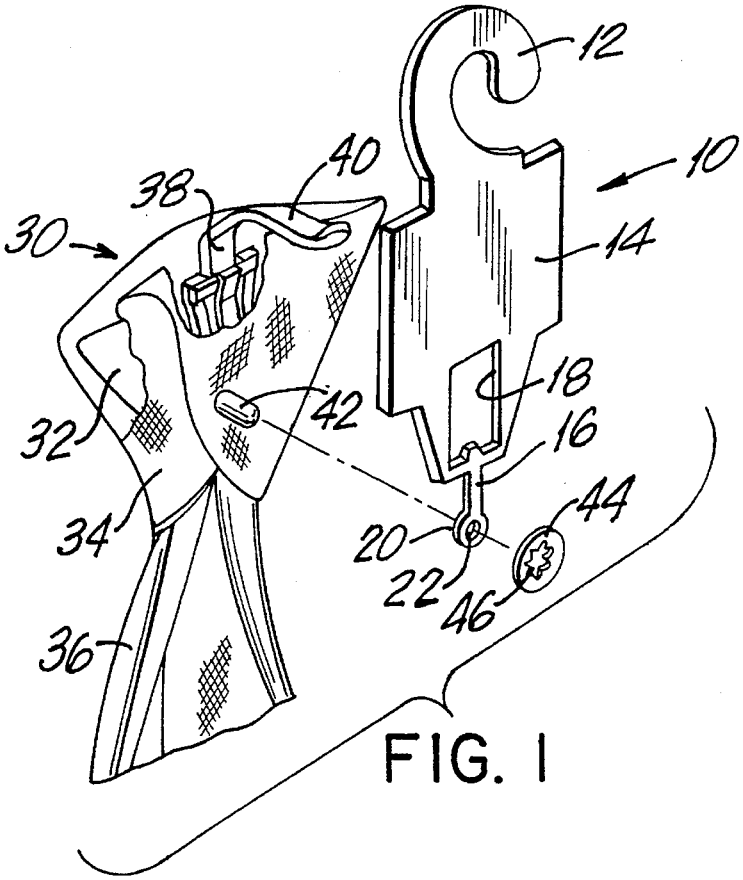
FIG. 1 is a perspective view of the hanger embodying the present invention together with a partial perspective view, with parts broken away, of a pre-tied knotted necktie assembly showing the hanger in position to be mounted to the assembly.

Referring to the drawings, and particularly to FIG. 1, there is shown a hanger 10 constructed in accordance with the present invention intended for use with a pre-tied knotted necktie assembly represented by numeral 30. Hanger 10 is formed having an upper hook portion 12, a central body portion 14, and lower stem portion 16. In the preferred embodiment, these portions are formed as an integral unit with hook portion 12 connected to body portion 14 which, in turn, is connected to stem portion 16.

Hanger 10 may be regarded as flat sheet-like member having a thickness of the hook and body portions 12, 14 being slightly greater than the thickness of stem portion 16. For example, whereas the thickness of the hook and body portions may be in the order of 0.06 inches (0.15 cm), the thickness of the stem portion may be 0.04 inches (0.10 cm). The relative thinness of stem portion 16 facilitates severing of said stem portion from body portion 14 as hereinafter described.

Hanger 10 preferably is formed of a plastic composition, such as polyethylene or styrene, or a mixture of both said compositions. This provides a product which is fairly tough to resist breakage and yet has some measure of flexibility for use as a hanger. That is, hook portion 12 is easily manipulated to engage and be suspended from a stationary bar or other display fixture.

Body portion 14 is formed having an enlarged opening 18 positioned close to stem portion 16. Opening 18 is disposed and sized to permit passage therethrough of the free end of a clip member which forms part of the necktie assembly 30 in a manner hereinafter described.

Stem portion 16 terminates in an enlarged end 20 having an opening 22 therethrough. Opening 22 is disposed and sized to permit passage therethrough of the free end of a post extending from the necktie assembly 30 in a manner also to be described hereinafter.

Figure 5:
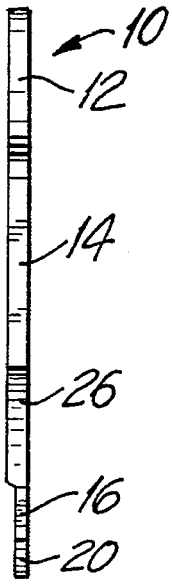
FIG. 5 is a side elevational view of the hanger of FIG. 4.
Figure 6:
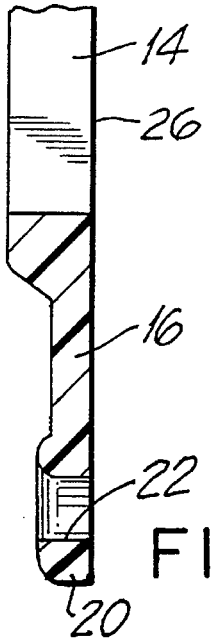
FIG. 6 is an enlarged sectional view of the lower stem portion of the hanger taken along line 6—6 of FIG. 4.

Hanger 10 also may be regarded as having a front surface 24 and a rear surface 26. Front surface 24 is intended to receive and retain marking indicia (not shown) such as the vendor's name and sale price of the item mounted to the hanger. In construction, the rear surfaces of the hook, body, and stem portions are flush or aligned with one another, as seen in FIGS. 5 and 6.

Figure 2:
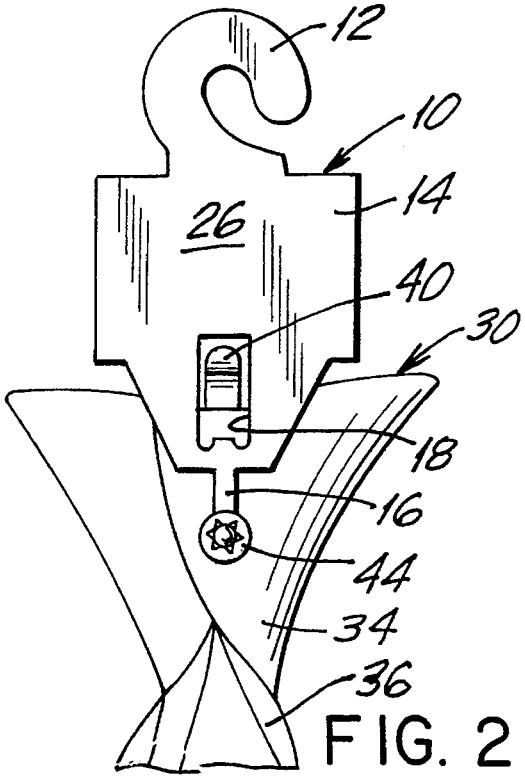
FIG. 2 is a partial rear elevational view of the hanger and necktie assembly of FIG. 1, mounted to one another, with the clip of the necktie assembly in its disengaging position.
Figure 3:
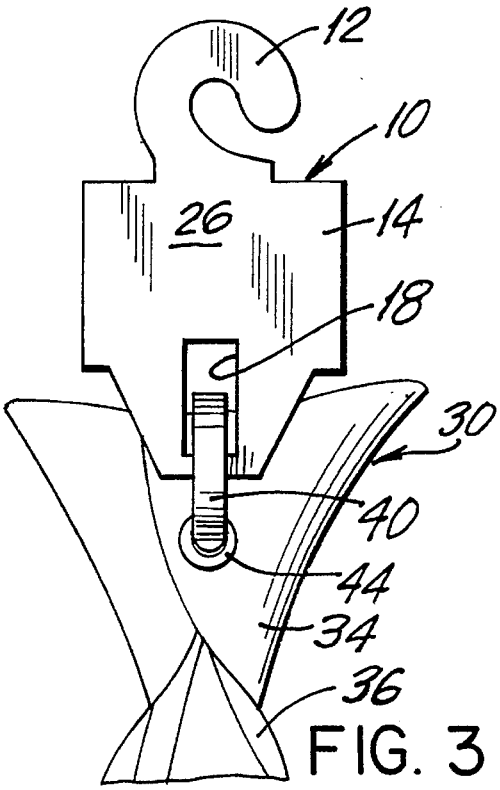
FIG. 3 is a view similar to FIG. 2 with the clip of the necktie assembly in its retaining position.
Figure 4:
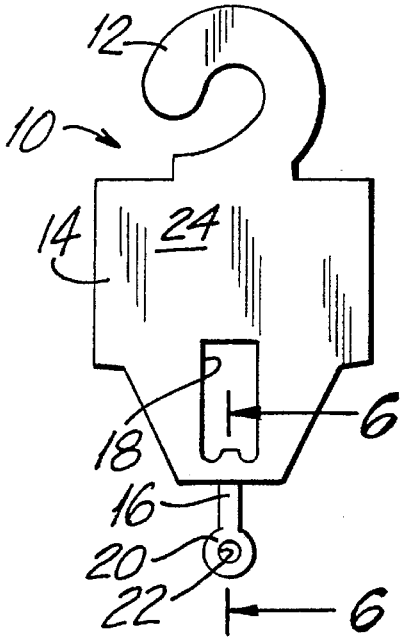
FIG. 4 is a front elevational view of the hanger shown in FIG. 1.

Necktie assembly 30 corresponds, for example, to the necktie knot support assembly disclosed in U.S. Pat. No. 4,337,539, the disclosure, construction, and operation of which are incorporated herein by reference. Briefly, assembly 30 comprises a main body member 32 shaped to determine formation of a knot 34 of a necktie 36, and a spring clamp 38 adapted to interengage with body member 32. Spring clamp 38 has a clip end 40 and is disposed for pivotal movement between a retaining or lowered position, as shown in FIG. 3, and a disengaging or raised position, as shown in FIGS. 1 and 2. Spring clamp 38 is provided for removably mounting necktie assembly 30 onto the neckband of shirt collar in the manner taught by said patent.

Necktie assembly 30 further includes a post 42 formed as part of body member 32 which extends outwardly from the rear surface of said body member. Post 42, as shown in FIG. 1, extends through the necktie knot 34 to aid in positioning the necktie 36 on the body member 32.

The hanger 10 and necktie assembly 30 are mounted together in the following manner. The clip end 40 of spring clamp 38 is moved to its disengaging position. The front surface 24 of hanger 10 is then positioned to overlie the rear surface of necktie knot 34, as shown in FIG. 1, with the clip end 40 passing through body opening 18, and with the end of post 42 passing through stem opening 22. Movement of spring clamp 38 to its retaining position at this point will bring clip end 40 into contact with post 42 to hold necktie assembly 30 on hanger 10. However, this would still permit a customer to replace the hanger with one having a lower sale price marking by simply moving the clip back to its disengaging position. Accordingly, in accordance with the invention, when the hanger 10 and the necktie assembly 30 are in their mounted position to one another, a retaining nut 44 having teeth-like gripping fingers 46 is frictionally mounted to post 42, with stem portion 16 positioned between the necktie knot 34 and nut 44, to secure necktie assembly 30 to hanger 10. Once nut 44 is in place, it is extremely difficult to remove it from the post. At this point, it matters little whether clip end 40 is moved to its retaining position or left in its disengaging position. For aesthetic reasons, it is preferred that clip end 40 be moved to its retaining position after nut 44 is in place. The important point is that by securely mounting stem portion 16 onto post 42 by means of nut 44, the customer now is unable to replace or switch hangers without physically cutting or mutilating the hanger. Such mutilation of the hanger would be readily detected at the check out counter or point of purchase to alert the vendor that a switch of hangers may have taken place.

Figure 7:
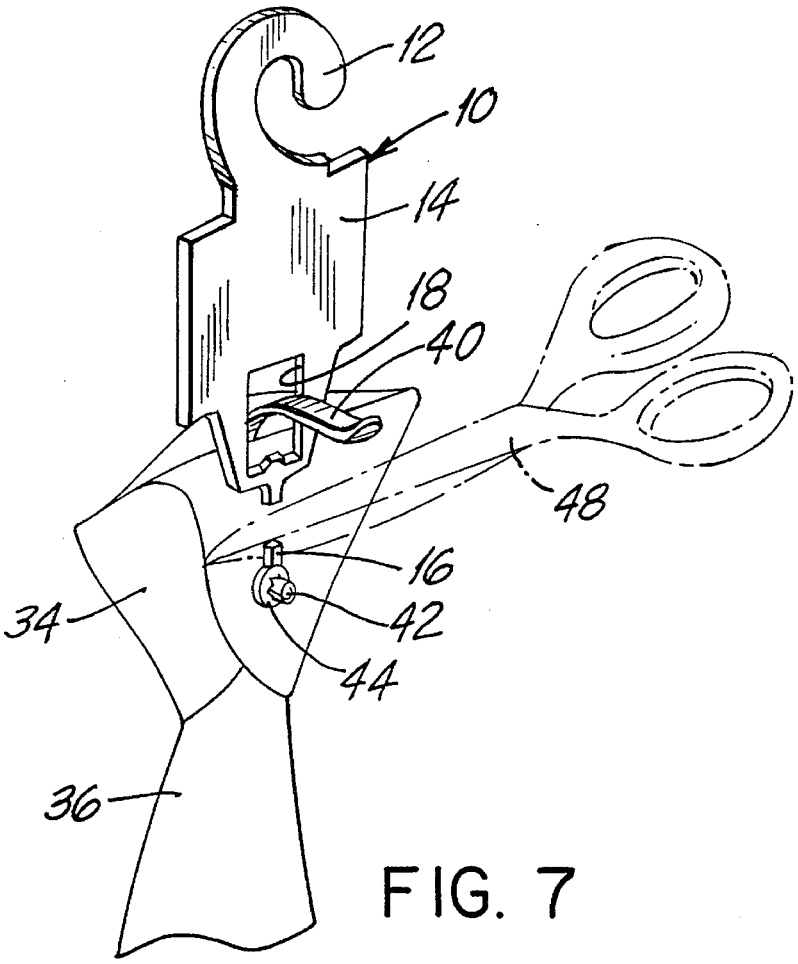
FIG. 7 is a perspective view of the hanger and necktie assembly of FIG. 1 after severing of the stem portion from the body portion of the hanger to permit removal of the body portion and the hook portion from the necktie assembly when the clip is in its disengaging position.

At such time as the customer wishes to lawfully remove the necktie assembly 30 from the hanger 10, after the point of purchase, the customer need only sever the stem portion 16 from body portion 14 using a scissor 48, as shown in FIG. 7. This serves to permit removal of the body portion 14 and the hook portion 12 from the necktie assembly 30. If clip 40 had previously been moved to its retaining position, as shown in FIG. 3, it is desirable to first move the clip back to its disengaging position, as shown in FIG. 7, to facilitate proper positioning of the scissor. A small segment of stem portion 16, that is the portion comprising the enlarged end 20, remains firmly mounted to post 42 by reason of nut 44. However, this does not detract from wearing necktie assembly 30 when in use.

It now will be appreciated that the severing procedure is preferably through the stem portion 16 of hanger 10 because of the relatively thin zone of this portion of the hanger as compared to the greater thickness of body portion 14. Nonetheless, such severing also could be done through the lower end of body portion 14, in the region of opening 18. However, this would leave a greater amount of hanger material connected to the necktie assembly which may be unsightly and cause discomfort to the wearer.

While a preferred embodiment of the invention has been shown and described in detail, it will be apparent to those skilled in the art that various changes and modifications may be made without departing from the basic principles of the invention as embraced by the following claims.

What is claimed is:

1. A hanger for a pre-tied knotted necktie assembly wherein the assembly includes a necktie, a knot support to form a necktie knot, a clip for removably mounting the necktie assembly onto the neckband of a shirt collar, and a positioning post extending through the necktie knot, said hanger comprising:

an upper hook portion, a central body portion, and a lower stem portion;

said upper hook portion being connected to said central body portion, and said central body portion being connected to said lower stem portion;

said body portion being adapted to retain the necktie assembly on said hanger;

said stem portion including an opening therethrough adapted to fit over the post of the necktie assembly; and a retaining nut which when placed over the post with said stem portion positioned between the necktie knot and the nut will securely maintain the necktie assembly on said hanger;

whereby the severing of said stem portion from said body portion of said hanger will permit removal of said body portion and said hook portion from the necktie assembly.

2. The hanger of claim 1, wherein said stem portion is attached to said body portion at a relatively thin zone of said hanger to facilitate severing of said stem portion.

3. The hanger of claim 1, wherein said hanger is a flat sheet-like member having a first thickness for said hook and body portions and a second thickness for said stem portion, said second thickness being less than said first thickness.

4. The hanger of claim 1, wherein said hook portion, said body portion and said stem portion of said hanger are formed as an integral unit.

5. A hanger adapted to be used with a pre-tied knotted necktie assembly wherein the assembly includes a necktie, a knot support to form a necktie knot, a clip for removably mounting the necktie assembly onto the neckband of a shirt collar, and a post extending through the necktie knot to position the necktie on the knot support, said hanger comprising:

an upper hook portion, a central body portion, and a lower stem portion;

said upper hook portion being connected to said central body portion, and said central body portion being connected to said lower stem portion;

said body portion being adapted to removably retain the necktie assembly on said hanger;

said stem portion including an opening therethrough positioned and sized to fit over the post of the necktie assembly with which said hanger is intended to be used; and a retaining nut which when placed on the post with said stem portion positioned between the necktie knot and the nut will securely maintain the necktie assembly on said hanger;

whereby the severing of said stem portion from said body portion of said hanger will permit removal of said body portion and said hook portion from the necktie assembly.

6. The hanger of claim 5, wherein said stem portion is attached to said body portion at a relatively thin zone of said hanger to facilitate severing of said stem portion.

7. The hanger of claim 5, wherein said hanger is a flat sheet-like member having a first thickness for said hook and body portions and a second thickness for said stem portion, said second thickness being less than said first thickness.

8. The hanger of claim 5, wherein said hook portion, said body portion and said stem portion of said hanger are formed as an integral unit.

9. The combination of a pre-tied knotted necktie assembly removably mounted on a display hanger wherein the assembly includes a necktie, a knot support on which the necktie is pre-tied to form a necktie knot, a clip for removably mounting the necktie assembly onto the neckband of a shirt collar, and a post extending through the necktie knot to aid in positioning the necktie on the knot support, said combination comprising:

said hanger having an upper hook portion, a central body portion, and a lower stem portion;

said upper hook portion being connected to said central body portion, and said central body portion being connected to said lower stem portion;

said clip being movable between a retaining position and a disengaging position;

said body portion of said hanger having an opening adapted to receive said clip and to hold said necktie assembly on said hanger with said clip in its retaining position;

said stem portion of said hanger having an opening positioned and sized to fit over said post; and a retaining nut on said post to secure said necktie assembly to said stem portion of said hanger;

whereby the severing of said stem portion from said body portion of said hanger will permit removal of said body portion and said hook portion from said necktie assembly.

10. The combination of claim 9, wherein said stem portion is attached to said body portion at a relatively thin zone of said hanger to facilitate severing of said stem portion.

11. The combination of claim 9, wherein said hanger is a flat sheet-like member having a first thickness for said hook and body portions and a second thickness for said stem portion, said second thickness being less than said first thickness.

12. The combination of claim 9, wherein said hook portion, said body portion and said stem portion of said hanger are formed as an integral unit.

13. The combination of claim 9, wherein said stem portion is severed from said body portion of said hanger when said clip is in its disengaging position.

* * * * *